US009386387B2

(12) United States Patent
Scott et al.

(10) Patent No.: US 9,386,387 B2
(45) Date of Patent: Jul. 5, 2016

(54) AUDIO MEASUREMENT AMPLIFIER

(71) Applicant: Listen, Inc., Boston, MA (US)

(72) Inventors: Anthony A. Scott, Eastchester, NY (US); Steve F. Temme, Boston, MA (US)

(73) Assignee: LISTEN, INC., Boston, MA (US)

( * ) Notice: Subject to any disclaimer, the term of this patent is extended or adjusted under 35 U.S.C. 154(b) by 65 days.

(21) Appl. No.: 14/283,522

(22) Filed: May 21, 2014

(65) Prior Publication Data

US 2014/0348335 A1 Nov. 27, 2014

Related U.S. Application Data

(60) Provisional application No. 61/826,630, filed on May 23, 2013.

(51) Int. Cl.

| | |
|---|---|
| ***H04R 3/00*** | (2006.01) |
| ***H04R 29/00*** | (2006.01) |
| *H04R 3/04* | (2006.01) |

(52) U.S. Cl.

CPC ..... *H04R 29/001* (2013.01); *H04R 3/00* (2013.01); *H04R 3/04* (2013.01); *H04R 2203/00* (2013.01)

(58) Field of Classification Search

None

See application file for complete search history.

(56) References Cited

U.S. PATENT DOCUMENTS

| | | | | |
|---|---|---|---|---|
| 5,068,903 | A * | 11/1991 | Walker | 381/96 |
| 2003/0072462 | A1 * | 4/2003 | Hlibowicki | 381/96 |
| 2004/0086140 | A1 * | 5/2004 | Fedigan et al. | 381/96 |
| 2009/0067643 | A1 * | 3/2009 | Ding | 381/96 |
| 2012/0121098 | A1 * | 5/2012 | Gautama | 381/59 |
| 2014/0270207 | A1 * | 9/2014 | Vinayak | 381/59 |

* cited by examiner

*Primary Examiner* — Andrew L Sniezek

(74) *Attorney, Agent, or Firm* — Occhiuti & Rohlicek LLP

(57) ABSTRACT

A circuit for conditioning an acoustic transducer driving signal includes an inner feedback circuit having a test signal input for receiving a test signal, a feedback input for receiving a feedback signal, circuitry for forming an output signal including circuitry for amplifying the input signal according to the feedback signal, and an output for providing the output signal. The circuit also includes an outer feedback circuit having a signal input for receiving the output signal from the inner feedback circuit, a desired offset input for receiving a signal representative of a desired output offset, a first low-pass filter circuit for detecting an actual offset in the output signal, signal combination circuitry for forming the feedback signal including combining the actual offset with the desired output offset, and a feedback output for providing the feedback signal to the feedback input of the inner feedback circuit.

14 Claims, 1 Drawing Sheet

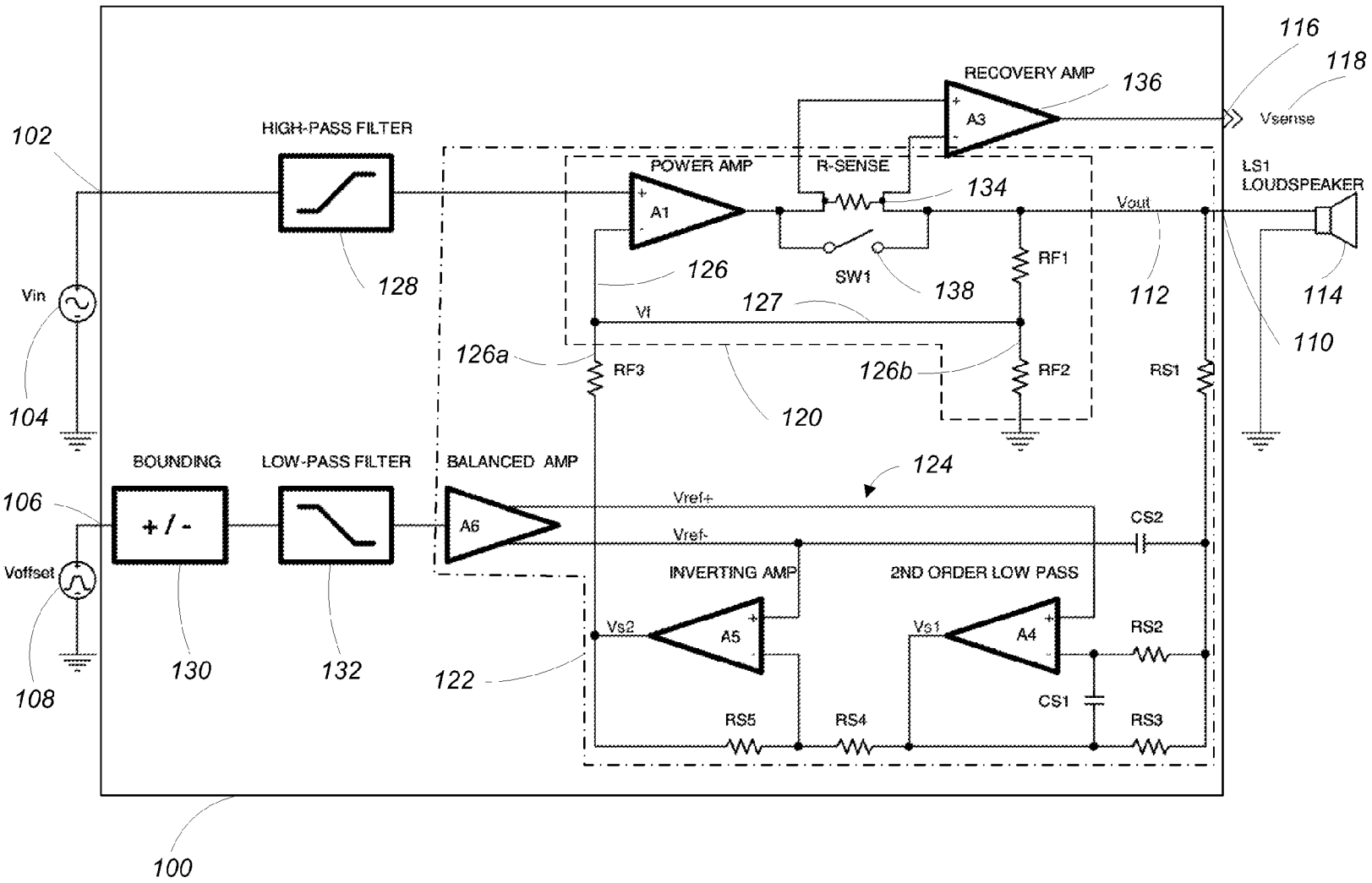
LS1
LOUDSPEAKER
Vsense
Vout
RECOVERY AMP
A3
R-SENSE
SW1
POWER AMP
A1
RF1
RF2
RF3
RS1
CS2
RS2
RS3
CS1
RS4
RS5
2ND ORDER LOW PASS
A4
Vs1
INVERTING AMP
A5
Vs2
Vref+
Vref-
Vf
BALANCED AMP
A6
HIGH-PASS FILTER
LOW-PASS FILTER
BOUNDING
+ / -
Vin
Voffset
100
102
104
106
108
110
112
114
116
118
120
122
124
126
126a
126b
127
128
130
132
134
136
138

AUDIO MEASUREMENT AMPLIFIER

CROSS-REFERENCE TO RELATED APPLICATIONS

The application claims the benefit of U.S. Provisional Application Ser. No. 61/826,630, filed May 23, 2013, the content of which is incorporated herein by reference.

BACKGROUND

This invention relates to a measurement amplifier for use in testing of acoustic transducers.

Measurement of an acoustic transducer (e.g., a loudspeaker) generally involves applying a calibrated and amplified stimulus signal to the acoustic transducer and sensing a response of the acoustic transducer to the stimulus using a calibrated sensor (e.g., a measurement microphone). From the stimulus and response, various output parameters of acoustic transducers can be measured, including but not limited to frequency response, impedance, distortion, total harmonic distortion, sensitivity, and so on.

Such measurements of output parameters are applicable in both the design and production phases of the acoustic transducer. In the design phase, a transducer designer can compare the measured output parameters to a design specification to determine how to adjust the physical characteristics of the transducer such that it meets the design specification. In the production phase, the measured output parameters of a given transducer can be compared to the measured output parameters of a reference transducer to determine whether the given transducer meets quality control standards.

SUMMARY

In an aspect, in general, a circuit for conditioning an acoustic transducer driving signal includes an inner feedback circuit having a test signal input for receiving a test signal, a feedback input for receiving a feedback signal, circuitry for forming an output signal including circuitry for amplifying the input signal according to the feedback signal, and an output for providing the output signal. The circuit also includes an outer feedback circuit having a signal input for receiving the output signal from the inner feedback circuit, a desired offset input for receiving a signal representative of a desired output offset, a first low-pass filter circuit for detecting an actual offset in the output signal, signal combination circuitry for forming the feedback signal including combining the actual offset with the desired output offset, and a feedback output for providing the feedback signal to the feedback input of the inner feedback circuit.

Aspects may include one or more of the following features.

The inner feedback circuit may include a sense resistor and the circuit for conditioning the audio test signal may include a sense voltage output for providing a signal representative of a voltage drop over the sense resistor. The circuit may also include a differential amplifier coupled to the terminals of the sense resistor for acquiring and amplifying the sense voltage. The sense resistor may be integral to the inner feedback loop such that the sense resistor is isolated from a device under test.

The circuit may include a high-pass filter circuit for high-pass filtering the test signal before the test signal arrives at the inner feedback loop. The circuit may includes voltage limiting circuit and a second low-pass filter circuit for voltage limiting and low-pass filtering the signal representative of the desired output offset before the signal representative of the desired output offset arrives at the outer feedback loop. The first low-pass filter may include an active low-pass filter. The circuit may include an inverter circuit wherein the active low-pass filter circuit is a second order inverting low-pass filter with its inverted output provided to the inverter circuit.

The circuit may include a balanced amplifier circuit configured to receive the signal representative of the desired output offset, generate two reference signals based on the signal representative of the desired output offset, the two reference signals having opposite polarity, and to provide the two reference signals to the second low-pass filter circuit. The first low-pass filter may have a cutoff frequency less than 10 Hz.

Embodiments may include one or more of the following advantages:

Among other advantages, the audio measurement amplifier is capable of accurately applying an offset (e.g., a DC or a very low frequency offset) to an acoustic transducer during measurement of the acoustic transducer. The audio measurement amplifier is capable of measuring the electrical impedance of the acoustic transducer with or without such an offset applied. Conventional amplifiers typically only allow for nulling of such offsets.

The servo mechanism of the outer feedback loop has an improved transient response time and is capable of quickly causing a desired offset to be accurately applied to the acoustic transducer when compared to conventional techniques.

Due to the integration of the sense resistor into the inner feedback loop, the sense resistor no longer influences the damping factor of the measurement system. As a result, the integration of the sense resistor into the inner feedback loop eliminates the affects of the sense resistor on the dynamic performance of the acoustic transducer.

Other features and advantages of the invention are apparent from the following description, and from the claims.

DESCRIPTION OF DRAWINGS

FIG. 1 is a first measurement amplifier circuit.

DESCRIPTION

1 Overview

Embodiments of the audio measurement amplifier circuit described herein have the ability to accurately apply an offset (e.g., a DC or a very low frequency offset) to an acoustic transducer during measurements of the acoustic transducer and have the ability to measure the complex electrical impedance of the voice coil both with and without the offset applied.

For the purposes of this description, a loudspeaker may be any sound reproduction transducer with an electrical input. In the case of an electrodynamic driver, the electrical signal is applied to a voice coil suspended in a magnetic field. Voice coil offset is the physical displacement of the voice coil. The voice coil offset may be unintentional or intentional. In this description, voice coil offset is the result of the intentional application of a DC or very low frequency voltage to an acoustic transducer under test. If the acoustic transducer is a loudspeaker, the offset causes the loudspeaker's diaphragm to physically move out of its center position. The offset also moves the voice coil in the magnetic gap and applies mechanical compression to the diaphragm suspension components. The methods described herein may also be useful other types of transducers that do not have voice coils.

The result is that the loudspeaker performance is altered by the offset. Loudspeaker researchers and manufacturers have a need to perform measurements on loudspeakers of various sizes in this offset condition for various reasons. For example, some power amplifier configurations intrinsically produce offset voltages on their output, and loudspeaker performance needs to be measured with the diaphragm offset.

In some examples, the offset voltages required range from 0V to several volts. The offset voltage needs to be adjustable, bipolar such that the device can be offset in either direction, and it must be possible to disable the offset.

Voice coil impedance for a single loudspeaker is a complex electrical quantity that represents a composite of several electrical, mechanical, and acoustical quantities including but not limited to voice coil resistance (electrical), voice coil inductance (electrical), voice coil mass (mechanical), diaphragm mass (mechanical), diaphragm suspension resistance and compliance (mechanical), diaphragm radiation impedance (acoustical), and acoustic loading of enclosure (acoustical) if the loudspeaker is mounted in an enclosure.

The voice coil complex electrical impedance can be derived when the excitation voltage applied to the voice coil is held constant and the magnitude and phase of the current through the voice coil are measured.

Measuring the magnitude and phase of the current while the excitation frequency is varied over the range of interest yields data that can be used to identify various modes of loudspeaker operation. One of the most significant data points is the frequency where lowest resonance point of the loudspeaker is attained. This is predominantly produced by the mechanical interaction of mass and compliance within the loudspeaker, and behaves as a spring-mass system. The magnitude at this point must be accurate to correctly calculate Thiele-Small parameters used for loudspeaker enclosure design and verification.

The mixture of quantities becomes more involved for multiple driver loudspeakers with crossover networks between the amplifier and voice coils. Additionally, all of these quantities vary over time, temperature, and as the power to the loudspeaker is increased. Each unit manufactured will be unique in regard to these quantities resulting in a specific impedance characteristic.

To summarize, loudspeaker researchers and manufacturers have a need to accurately measure this important parameter for a wide range of loudspeaker sizes and types.

Referring to FIG. 1, one embodiment of a measurement amplifier circuit 100 is configured to facilitate acoustic transducer measurements including impedance measurements with a predetermined offset applied to the acoustic transducer 114. The circuit 100 includes a test signal input 102 for receiving a test signal 104 a desired offset signal input 106 for receiving a desired offset signal 108, and a test signal output 110 for providing an output signal 112 to an acoustic transducer 114 (e.g., a loudspeaker). The circuit 100 also includes a sense voltage output 116 for providing a sense voltage 118 to downstream impedance calculation circuitry (not shown). In some examples, the sense voltage 118 is proportional to the current through the acoustic transducer under test.

The circuit 100 is configured to perform a number of functions including test signal conditioning (e.g., amplification of the test signal 104, offset addition to the test signal 104) and measurement of signals representative of device impedance.

2 Test Signal Conditioning

To condition the test signal 102, the circuit 100 includes an inner feedback loop 120 nested inside an outer feedback loop 122. The inner feedback loop 120 includes a non-inverting amplifier which amplifies a combination of the test signal 102 and a feedback signal 126 to generate the output signal 112. As is indicated in FIG. 1, the feedback signal 126 is a combination (on the circuit node 127 joining resistors RF3 and RF2) of an outer feedback signal component 126*a* (encoded as a current through resistor RF3) and an inner feedback signal component 126*b* (encoded as a current through resistor RF2). The outer feedback loop 122 includes a servo mechanism 124 for offset detection (e.g., a second order inverting low-pass filter and an inverting amplifier) and generates the outer feedback signal component 126*a* which, when combined with the inner feedback signal component 126*b* to form the feedback signal 126, causes any offset in the output signal 112 due to the offset in the feedback loop 120 to be nulled and causes the desired amount of offset specified by the desired offset signal 108 to be added to in the output signal 112. In this way a user of the measurement amplifier can precisely control the amount of amplification and the amount of DC offset present in the output signal 112.

In some examples, a high-pass filter 128 is included between the test signal input 102 and the non-inverting amplifier of the inner feedback loop 120 in order to attenuate frequencies of the test signal 104 which fall within the pass band of the second order low-pass filter of servo mechanism 124. In this way, saturation of the amplifiers in the servo can be avoided since frequencies that are close to the pole frequency of the servo 124 are attenuated. The high-pass filter 128 also removes any low frequency oscillations in the test signal 104 which could potentially cause unwanted oscillations in the output signal 112.

In some examples, a voltage limiter 130 and a low-pass filter 132 are disposed between the desired offset signal input 106 and the outer feedback loop 122. The voltage limiter 130 limits the magnitude of the desired offset signal 108 to prevent saturation of the amplifiers in servo mechanism 124, and eliminate noise or excessive voltages in the desired offset signal 108 from perturbing the feedback loops 120, 122. The low-pass filter 132 removes noise from the desired offset signal 108 to further prevent perturbation of the feedback loops 120, 122 due to the desired offset signal 108.

3 Impedance Signal Measurement

In some examples, the inner feedback loop 120 includes an integral sense resistor 134 having its terminals connected to a differential amplifier 136 which amplifies the differential signal across the sense resistor 134. Making the sense resistor 134 integral to the inner feedback loop 120 rather than being connected in series with the acoustic transducer 114 provides a number of advantages as described above when measuring certain device parameters (e.g., device impedance).

In some examples, a switch 138 is added to the inner feedback loop 120 such that the integral sense resistor 134 can be bypassed when impedance measurements are not required.

4 Implementations

In some examples, systems that implement the techniques described above are implemented in analog electronic circuitry. However, it is noted that in some examples, portions of systems that implement the techniques described above can be implemented in software, in firmware, in digital electronic circuitry, or in computer hardware, or in combinations of them. The system can include a computer program product tangibly embodied in a machine-readable storage device for execution by a programmable processor, and method steps can be performed by a programmable processor executing a program of instructions to perform functions by operating on input data and generating output. Portions of the system can be implemented in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

It is noted that, while the above description generally relates to using the measurement amplifier circuit for audio test and measurement purposes, the uses of the measurement amplifier circuit are not limited to audio test and measurement. For example, For example, several parameters of passive and active components such as capacitors (capacitance and dissipation factor), inductors (inductance and Q-factor), transformers (core linearity, leakage and mutual inductance, interwinding capacitance, turns ratio), thermistors and varistors (AC impedance), semiconductors (C-V effects within diodes, varactors, and MOSFETs) may be measured. Circuit parameters such as the resonant frequency and Q-factor of tuned circuits or input impedance may be measured. With additional components, the audio measurement amplifier circuit described herein may be part of a process to measure the internal impedance of batteries or system parameters such as ground impedance or cable impedance. In all of the cases above, measurements may be implemented with large or small AC signals, with a DC offset (bias) or low frequency offset, or without any offset applied.

It is to be understood that the foregoing description is intended to illustrate and not to limit the scope of the invention, which is defined by the scope of the appended claims. Other embodiments are within the scope of the following claims.

What is claimed is:

1. A circuit for conditioning an acoustic transducer driving signal comprising:

an inner feedback circuit having a test signal input for receiving a test signal;

a feedback input for receiving an outer component of a feedback signal;

a circuit node for combining the outer component of the feedback signal with an inner component of the feedback signal to form the feedback signal;

circuitry for forming an output signal including circuitry for providing the inner component of the feedback signal to the circuit node and circuitry for amplifying the test signal according to the feedback signal; and an output for providing the output signal;

an outer feedback circuit having a signal input for receiving the output signal from the inner feedback circuit;

a desired offset input for receiving a signal representative of a desired output offset;

a servo circuit for detecting an actual offset in the output signal, the servo circuit including a first low pass filter circuit;

signal combination circuitry for forming the outer component of the feedback signal including combining the actual offset with the desired output offset; and a feedback output for providing the outer component of the feedback signal to the feedback input of the inner feedback circuit.

2. The circuit of claim 1 wherein the inner feedback circuit includes a sense resistor and the circuit for conditioning the acoustic transducer driving signal includes a sense voltage output for providing a signal representative of a voltage drop over the sense resistor.

3. The circuit of claim 2 further comprising a differential amplifier coupled to the terminals of the sense resistor for acquiring and amplifying the sense voltage.

4. The circuit of claim 3 wherein the sense resistor is integral to the inner feedback loop such that the sense resistor is isolated from a device under test.

5. The circuit of claim 1 including a high-pass filter circuit for high-pass filtering the test signal before the test signal arrives at the inner feedback loop.

6. The circuit of claim 1 wherein the first low-pass filter has a cutoff frequency less than 10 Hz.

7. The circuit of claim 1 wherein the acoustic transducer driving signal comprises an audio test signal.

8. The circuit of claim 1 wherein the actual offset and the desired output offset are direct current (DC) offsets.

9. The circuit of claim 1 wherein the desired output offset is a non-zero offset.

10. The circuit of claim 9 wherein the desired output offset is a direct current (DC) offset.

11. The circuit of claim 1 wherein the circuitry for amplifying the test signal according to the feedback signal is configured to introduce an offset into the output signal according to the feedback signal.

12. A circuit for conditioning an acoustic transducer driving signal comprising:

an inner feedback circuit having a test signal input for receiving a test signal;

a feedback input for receiving an outer component of a feedback signal;

a circuit node for combining the outer component of the feedback signal with an inner component of the feedback signal to form the feedback signal;

circuitry for forming an output signal including circuitry for providing the inner component of the feedback signal to the circuit node and circuitry for amplifying the test signal according to the feedback signal; and an output for providing the output signal;

an outer feedback circuit having a signal input for receiving the output signal from the inner feedback circuit;

a desired offset input for receiving a signal representative of a desired output offset;

a servo circuit for detecting an actual offset in the output signal, the servo circuit including a first low pass filter circuit;

signal combination circuitry for forming the outer component of the feedback signal including combining the actual offset with the desired output offset; and a feedback output for providing the outer component of the feedback signal to the feedback input of the inner feedback circuit; and a voltage limiting circuit and a second low-pass filter circuit for voltage limiting and low-pass filtering the signal representative of the desired output offset before the signal representative of the desired output offset arrives at the outer feedback loop.

13. A circuit for conditioning an acoustic transducer driving signal comprising:

an inner feedback circuit having a test signal input for receiving a test signal;

a feedback input for receiving an outer component of a feedback signal;

a circuit node for combining the outer component of the feedback signal with an inner component of the feedback signal to form the feedback signal;

circuitry for forming an output signal including circuitry for providing the inner component of the feedback signal to the circuit node and circuitry for amplifying the test signal according to the feedback signal; and an output for providing the output signal;

an outer feedback circuit having a signal input for receiving the output signal from the inner feedback circuit;

a desired offset input for receiving a signal representative of a desired output offset;

a servo circuit for detecting an actual offset in the output signal, the servo circuit including a first active low pass filter circuit;

signal combination circuitry for forming the outer component of the feedback signal including combining the actual offset with the desired output offset;

an inverter circuit, wherein the first active low-pass filter circuit is a second order inverting low-pass filter with its inverted output provided to the inverter circuit; and a feedback output for providing the outer component of the feedback signal to the feedback input of the inner feedback circuit.

14. The circuit of claim 13 further comprising a balanced amplifier circuit configured to receive the signal representative of the desired output offset, generate two reference signals based on the signal representative of the desired output offset, the two reference signals having opposite polarity, and to provide the two reference signals to the second low-pass filter circuit.

* * * * *